United States Patent [19]

Gasparini

[11] Patent Number: 4,863,336

[45] Date of Patent: Sep. 5, 1989

[54] TRASH PICK-UP TRUCK

[75] Inventor: Giorgio Gasparini, Milan, Italy

[73] Assignee: Bergomi S.p.A., Milan, Italy

[21] Appl. No.: 176,372

[22] Filed: Mar. 31, 1988

[30] Foreign Application Priority Data

Apr. 1, 1987 [IT] Italy ..... 19928 A/87

[51] Int. Cl.[4] ..... B65F 3/00

[52] U.S. Cl. ..... 414/525.54

[58] Field of Search ..... 414/525 R

[56] References Cited

U.S. PATENT DOCUMENTS

| | | | |
|---|---|---|---|
| 3,682,336 | 8/1972 | Wieschel et al. | 414/525 R |
| 3,940,006 | 2/1976 | Smith | 414/525 X |
| 4,065,008 | 12/1977 | Ratledge | 414/525 |
| 4,460,307 | 7/1984 | Durant et al. | 414/525 |

FOREIGN PATENT DOCUMENTS

| | | | |
|---|---|---|---|
| 96014 | 12/1983 | European Pat. Off. | 414/525 R |

*Primary Examiner*—Andres Kashnikow
*Assistant Examiner*—Patrick N. Burkhart
*Attorney, Agent, or Firm*—Birch, Stewart Kolasch & Birch

[57] ABSTRACT

A trash pick-up truck which has high strength features and an improved arrangement for compacting and transfering trash from the collecting pan defined in the cowl into the truck body, comprises a passageway formed between the cowl and the truck body, a movable plate having a plate-like pressure extension or paddle articulated thereto, and a device for supporting and guiding the plate under the cowl in a friction- and wear-free manner including two rod pairs which form, in cooperation with the cowl and plate, two respective articulated antiquadrilaterals.

2 Claims, 3 Drawing Sheets

TRASH PICK-UP TRUCK

BACKGROUND OF THE INVENTION

This invention relates to a trash pick-up truck comprising a truck body, a cowl mounted on the truck body back and defining a collecting pan at its bottom, a passageway between the cowl and the truck body restricted by a partition wall at its top, a movable plate and a plate-like pressure extension articulated thereto for transfering and compacting trash, from the collecting pan into the truck body through said passageway, and a device for supporting and guiding said plate on the cowl inside.

As is known, to transfer trash from the collecting pan into the truck body, a movable plate is used which is supported in a guided manner inside the cowl and has a plate-like pressure extension or paddle articulated thereto.

The coordinated cyclic movements of the plate and its extension by appropriate motor means provide the desired transfer of the trash material from the collecting pan into the truck body and its concurrent compaction.

In this respect, owing to the considerably large magnitude of the forces brought into play during the trash transfer step, and especially during the trash compacting step, it becomes necessary to have the movable plate supported and guided in an adequately robust manner.

An example of a truck as indicated is described in U.S. Pat. No. 4,042,134. The movable plate supporting and guiding arrangement is therein a rod-type linkage forming two articulated quadrilaterals which guide the plate along an arcuate path facing the passageway between the cowl and the body with its concave side. While performing satisfactorily from the standpoint of its strength, that truck has a disadvantage originating from the very path travelled by the plate and pressure extension. The movable plate must be given an arcuate profile shape in order to keep close to the partition wall and prevent trash from flowing upwards, and the collecting pan bottom shape is, in turn, required to conform with the path travelled by the pressure extension, and this by means of two consecutive arcuate sections having oppositely directed curvatures and forming, accordingly, an angle therebetween.

It follows that as the plate-like extension travels the pan profile to empty the pan of the trash therein and transfer such trash into the truck body, the trash material is conveyed in a discontinuous manner and allowed to trip over the sharp angled intersect line.

Italian application No. 21515-A/82 by this same Applicant discloses another example of a truck as indicated, wherein the movable plate is supported by a rod-type linkage forming two articulated quadrilaterals which guide the plate along an arcuate travel path facing the passageway with its concave side. This prior approach, additionally to providing adequate strength, does provide for the pressure extension to travel through two consecutive arcs having concurrent curvatures and merging, therefore, with each other in a continuous fashion. Thus, this prior approach enables the trash collecting pan to be emptied without snags.

However, a prerequisite thereof is that the plate be given an arcuate profile in order for it to keep close to the partition wall and prevent the upflow of trash.

It also has the disadvantage of taking up an excessively large proportion of the cowl useful volume, thereby restricting the space available to accommodate the trash material when large-size containers are emptied into the pan. Lastly, the reaction to the trash compacting force toward the truck body, due to the large forces acting through the double pair of linkage rods whose fixed ends are pivoted to the rearward cowl portion, requires a high strength anchoring construction, which reflects unfavorably on the weight of the rear region, thereby the weight distribution to the truck axles is also affected adversely.

SUMMARY OF THE INVENTION

The problem underlying this invention is to provide a truck of the type specified hereinabove, which has such constructional and operational characteristics as to meet the above-noted demand for strength while overcoming the cited disadvantages of the prior art.

This problem is solved by a truck as indicated being characterized in that the device comprises at least one rod pair formed of upper and lower rods and having one end pivoted to the cowl and the other end pivoted to the plate, and forming an articulated quadrilateral with the cowl and the plate the fixed side whereof is provided by the cowl and the moving side by the plate.

BRIEF DESCRIPTION OF THE DRAWINGS

Further features and the advantages of the truck according to the invention will be apparent from the following detailed description of a preferred embodiment, to be taken by way of illustration and not of limitation in conjunction with the accompanying drawings, where.

DETAILED DESCRIPTION OF PREFERRED EMBODIMENTS

Figure 1:
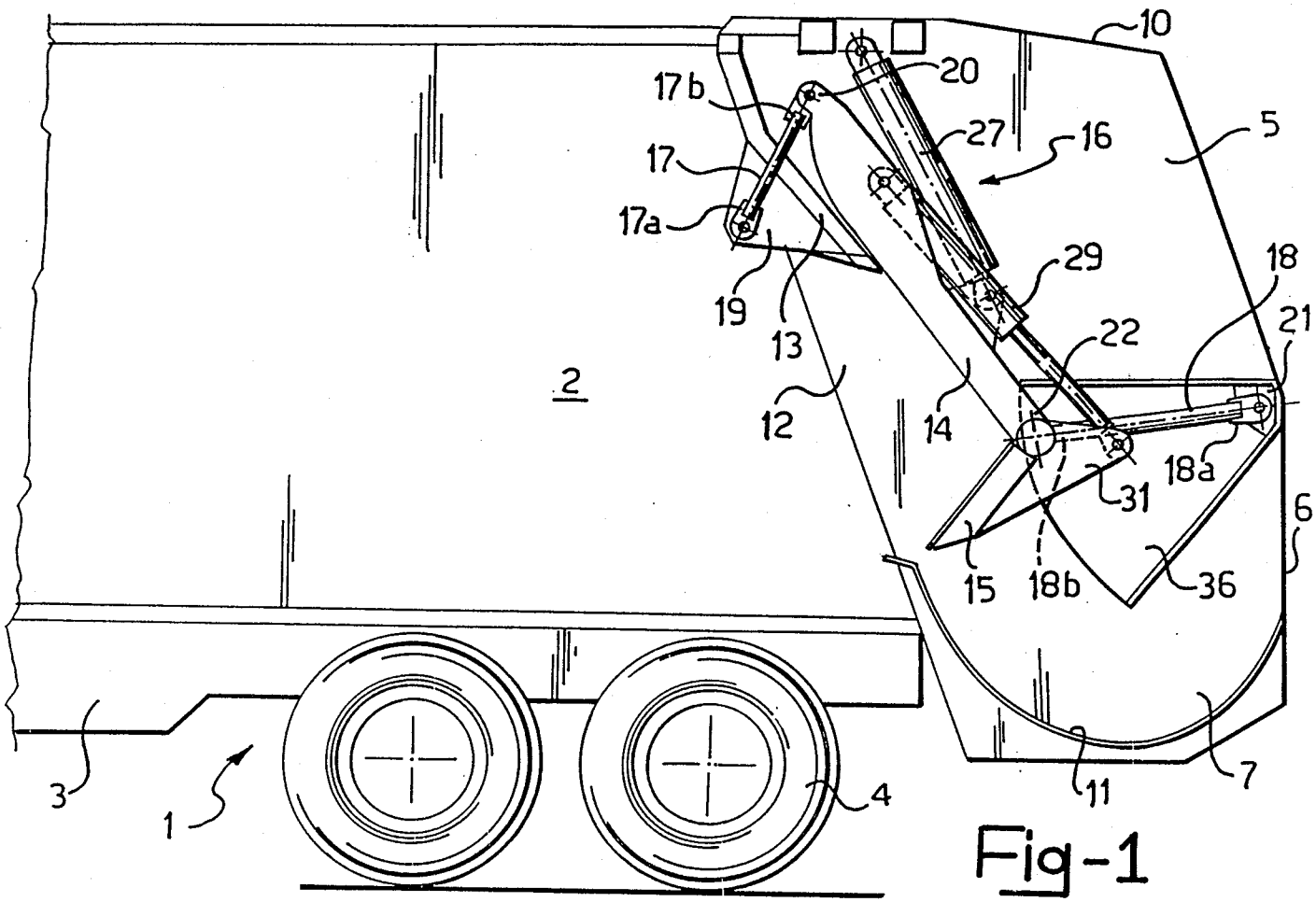
FIG. 1 is a part-sectional side view of a detail of a trash pick-up truck according to the invention.
Figure 3:
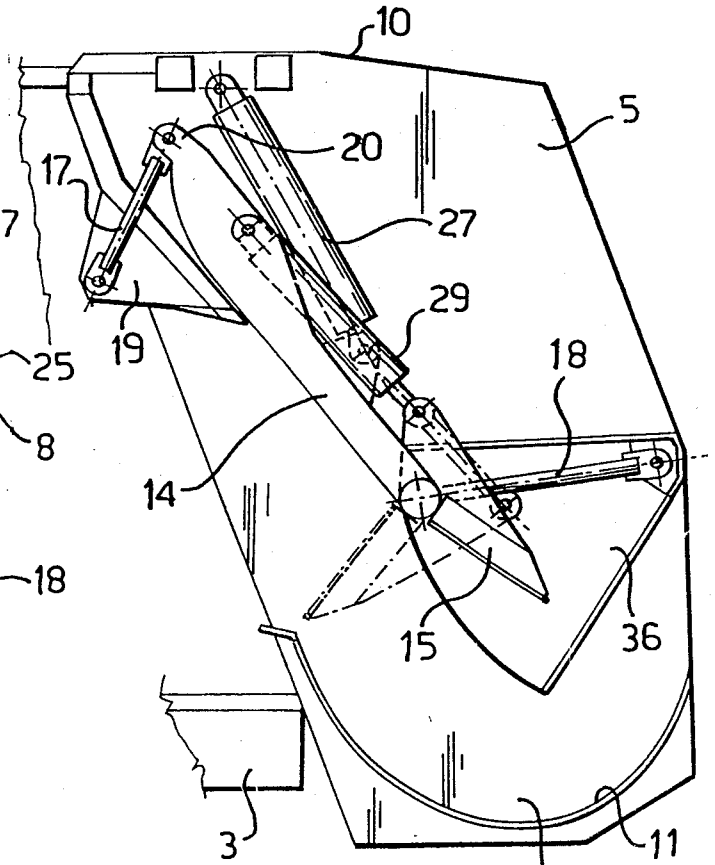
FIGS. 3, 4 and 5 are side views showing the truck of FIG. 1 at different stages of its operation.
Figure 2:
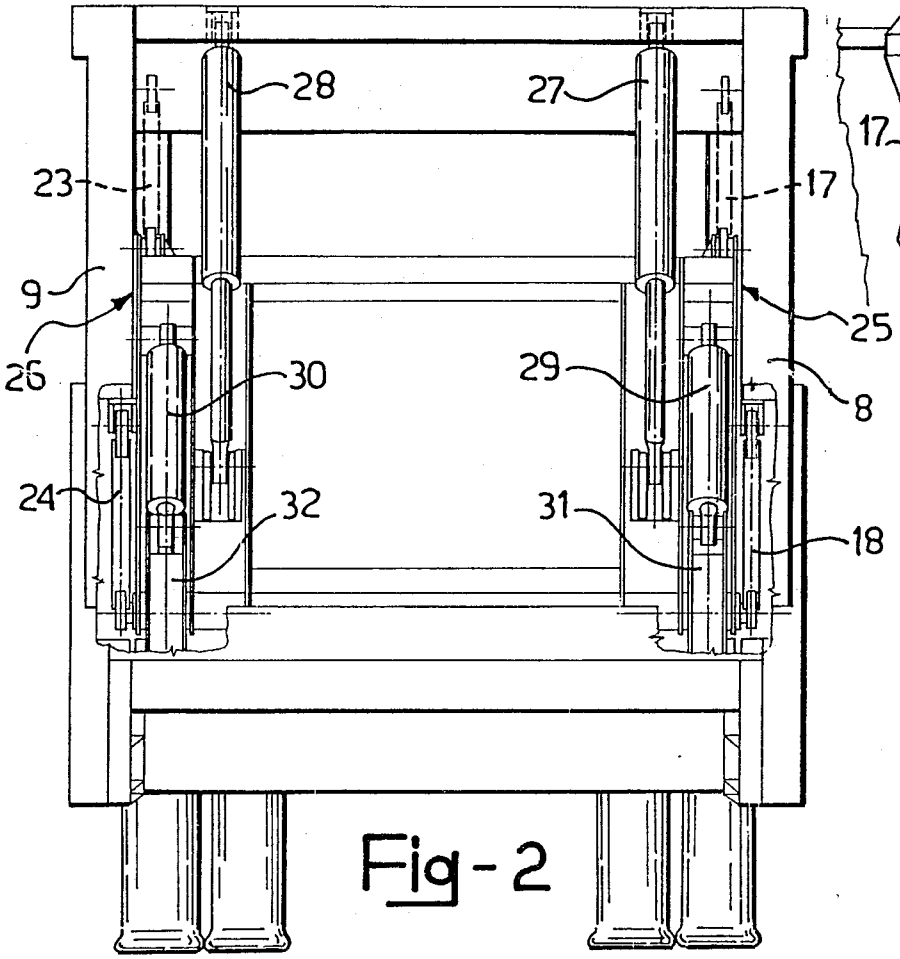
FIG. 2 is a rear view of the truck according to the invention.
Figure 5:
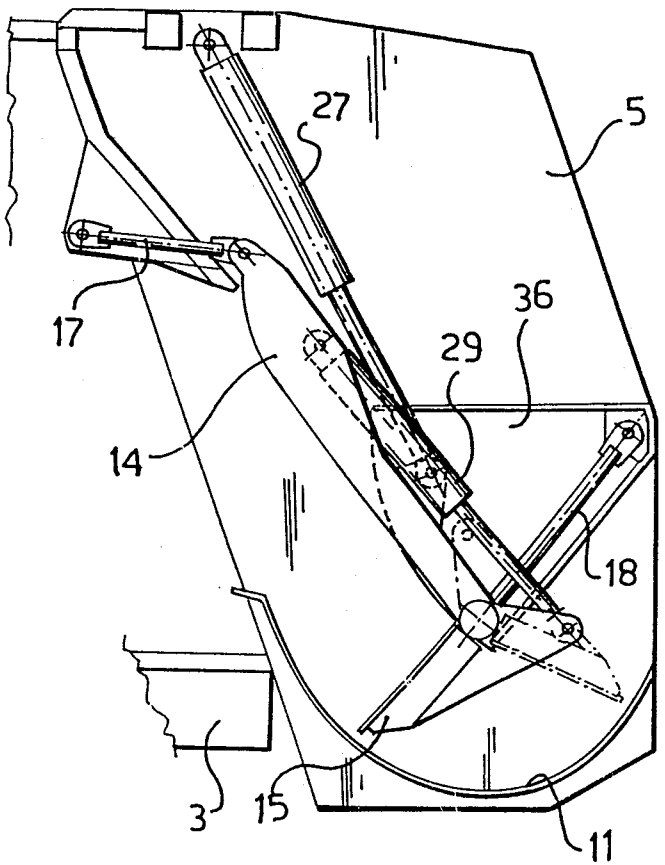
Figure 4:
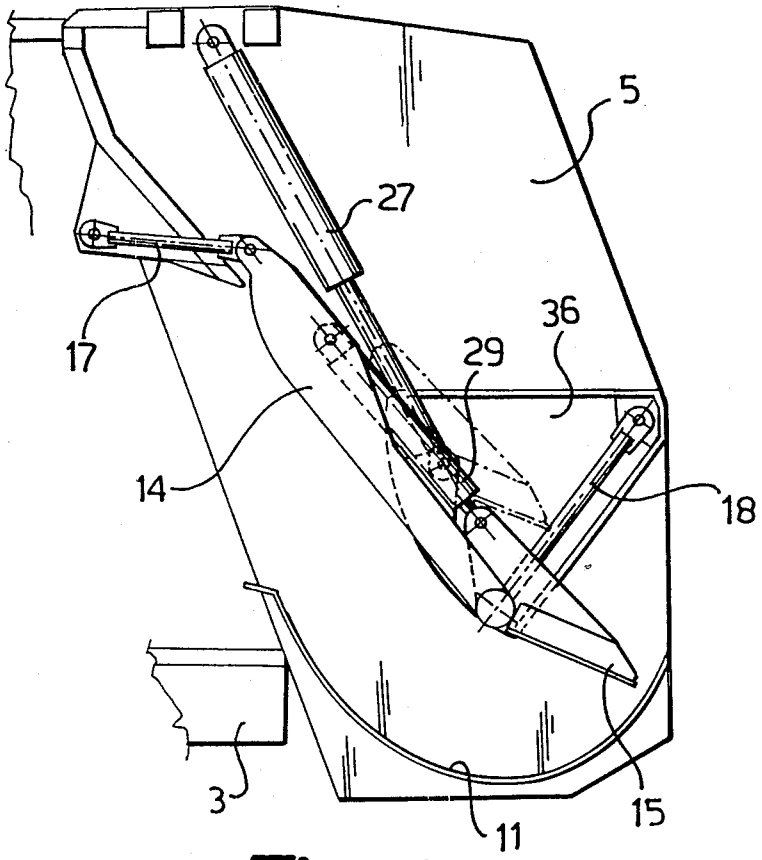

With reference to the accompanying drawing views, the numeral 1 denotes a trash pick-up truck of which only a rear portion has been depicted.

The truck 1 comprises a truck body 2 which is substantially parallelpipedic in shape and secured on a main frame 3 mounted on wheels 4.

Mounted on the rear of the truck body 2 is a cowl 5 which is apertured rearwardly as at 6 for the introduction of trash material and has a trash collecting pan 7 defined therein.

The truck body 2 and cowl 5 are formed from sheet metal of approriate thickness reinforced with suitable rib formations.

In particular the cowl 5 is bounded by parallel sidewalls 8 and 9, a top wall 10, and a bottom wall 11 constituting the bottom of the pan 7.

Between the cowl 5 and the truck body 2 there is defined a passageway 12 which is bounded at the top by a partition wall 13 depending subvertically from the rear wall 10 of the cowl 5.

The truck 1 further includes a rectangular movable plate 14 which extends subvertically inside the cowl 5 between the sidewalls 8 and 9 thereof, at a location facing the passageway 12.

The movable plate 14 is provided with a plate-like pressure extension 15, also referred to as paddle, which is rectangular in shape, extends between said walls 8 and 9, and is articulated to the plate 14 along its bottom side.

The movable plate 14 is connected to the cowl 5 of the truck 1 with the intermediary of a supporting and guiding device generally designated 16 and described hereinbelow.

The device 16 comprises, in accordance with this invention, a first rod pair 17, 18 lying on a perpendicular plane to the plate 14, on the wall 8 side.

In that rod pair 17, 18, the upper rod 17 is located, relatively to the plate 14, on the same side as the passageway 12, and at a short distance away from the wall 8, whereas the lower rod 18 is located on the opposite side relatively to the passageway 12 and is accommodated within a recess 36 purposely provided in the wall 8.

The rod 17 has one end 17*a* pivoted to a support 19 affixed to the sides of the partition wall 13 of the cowl 5 and jutting out toward the body 2, and an opposing end 17*b* pivoted to a support 20 affixed to the movable plate 14 at its top edge.

The rod 18 has one end 18*a* pivoted to a support 21 affixed to the cowl 5 within the recess 36, and an opposing end 18*b* pivoted to a support 22 affixed to the movable plate 14 at its bottom edge.

In quite a similar manner, the device 16 comprises a second rod pair 23, 24, quite identical of the rods 17 and 18 and being likewise pivoted to the cowl 5 and the plate 14 and lying on a perpendicular plane to the plate 14 on the wall 9 side.

The rod pair 17, 18, as well as the rod pair 23, 24, form with the cowl 5 and the plate 14 respective articulated antiquadrilaterals indicated at 25 and 26, respectively, wherein the fixed sides and moving sides intersect each other and consist of the cowl 5 and plate 14, respectively.

It should be considered for accuracy of illustration that the expression "articulated antiquadrilateral" has quite the same meaning as the expression "articulated antiparallelogram" that in mechanics applied to machinery refers to a particular articulated parallelogram wherein the fixed side and moving side intersect each other.

By virtue of the device 16 being in the form of an articulated antiquadrilateral, the plate 14 is supported and guided to travel a substantially straight path.

The movement of the movable plate 14 along said substantially straight travel path is imparted by a pair of identical parallel cylinders 27 and 28 having opposing ends made fast to the top wall 10 of the cowl 5 and to the plate 14, respectively.

The angular movement of the plate-like pressure extension 15 relatively to the plate 14 is imparted by a pair of identical parallel cylinders 29 and 30 having opposing ends respectively anchored to the plate 14 and expansions 31 and 32 of the extension 14 jutting out substantially beyond the articulation axis relatively to the extension 15 itself.

In particular, the plate 14 is reciprocable, under the cooperating actions of the cylinders 27 and 28, along said substantially straight subvertical travel path relatively to the partition wall 13, between a first, raised position and a second, lowered position.

This takes place because of the top and bottom ends of the plate travelling respective arcuate paths with opposite curvatures, thanks to the rods being positioned on opposing sides to the plate.

The upflow of trash material is prevented by the substantially doctoring blade type of fit of the bottom edge of the partition wall 13 to the plate 14 provided.

The plate-like pressure extension 15 is reciprocable, under the cooperating actions of the cylinders 29 and 30, between a first angular position where it forms an angle of about 120° to that face of the plate 14 which confronts the passageway 12 and a second angular position, where it forms an angle of about 220° to that same face.

The operation of the truck 1 according to the invention will be next described with reference to a starting condition (see FIG. 1) under which the plate 14 and extension 15 are both in their first positions.

After the pan 7 has been filled with trash material, the extension 15 is moved to its second position. Then, the plate 14 is moved to its lowered position. During this movement, the plate-like extension 15 will press and compact the trash against the bottom wall 11 of the cowl 5 constituting the bottom of the pan 7.

At this time, the extension 15 is returned to its first position through an angular movement of about 110°. Thus, it empties of the trash a first section of the pan 7 bottom. This section would be advantageously configured as a circular arc agreeing with the path travelled by the free edge of the extension 15.

Finally, the plate 14 is also moved back to its first position. This results in a remaining section of the pan 7 bottom being emptied of trash and the trash material being discharged into the body 2 through the passageway 12, to undergo an additional compacting effect. This remaining section of the pan 7 bottom would be advantageously configured with a circular arc profile agreeing with the path travelled by the free edge of the extension 15 as occupying its second position, when the plate 14 completes its travel path.

Said circular arc sections merge together continuously and have their concave sides both facing the interior of the pan 7.

It should be noted that during the plate movement from its second position to its first position, by virtue of its travel path being substantially a straight line, the plate will retain a substantially constant setting relatively to the partition wall.

The main advantage of the truck according to this invention resides in the effective way the trash is compacted and transfered from the collecting pan into the truck body, as afforded by the supporting and guiding device for the movable plate. The peculiar arrangement of the rod positions, in addition to involving no space restrictions or necessity for opening with respect to the sidewalls of the cowl, provides, on account of the peculiar geometry assumed by the rods in their travel paths accompanying the movable plate, increased trash compacting force during the final step, in the upper region of the passageway as the plate is moved from its second position to the first position.

Lastly, the smooth pattern of the sections forming the bottom wall of the collecting pan is beneficial to the action transfering the trash from the pan into the truck body.

A further advantage of the inventive truck resides in the decreased space requirements under the cowl, as brought about by the substantially straight design of the plate whose thickness can be selected to just meet its strength requirements, it being no longer required to have concave or convex portions in order to ensure a tight fit to the partition wall.

An additional advantage of the truck according to the invention resides in the compact size of the cowl, especially in the upper region thereof. The particular arrangement of the upper rod positions, such that they are pivoted to the forward portion of the cowl on the truck body side, results in an adequately strong supporting construction in said forward portion and consequent lightening of the rear portion which is left unstressed. Accordingly, the overall truck design has been improved as regards the weight distribution to the truck axles.

Understandably, the truck described in the foregoing may be variously altered and modified by a skilled person in the art to meet specific contingent demands, without departing from the true scope of the invention as set forth in the appended claims.

What I claim is:

1. A trash pick-up truck comprising a truck body, a cowl mounted on the truck body back and defining a collecting pan at its bottom, a passageway between the cowl and the truck body restricted by a partition wall at its top, a movable plate and a plate-like pressure extension articulated thereto for transferring and compacting trash, from the collecting pan into the truck body through said passageway, and a device for supporting and guiding said plate on the cowl inside, said device comprises at least one rod pair formed of upper and lower rods with each of said rods having one end pivoted to the cowl and the other end pivoted to the plate, and forming an articulated antiquadrilateral with the cowl and the plate wherein the fixed side thereof is provided by the cowl and the moving side by the plate.

2. A truck according to claim 1, wherein said at least one rod pair the upper rod is located relatively to the plate on the same side as the passageway, and the lower rod on the opposite side.

* * * * *